United States Patent [19]

Dragner

[11] Patent Number: 4,906,299

[45] Date of Patent: Mar. 6, 1990

[54] LUBRICATING INSOLUBILIZER FOR PAPER COATING COMPOSITION

[75] Inventor: Louis R. Dragner, Rock Hill, S.C.

[73] Assignee: Sequa Chemicals Inc., Chester, S.C.

[21] Appl. No.: 250,529

[22] Filed: Sep. 29, 1988

[51] Int. Cl.[4] ..... C08L 3/00

[52] U.S. Cl. ..... 106/214; 106/243; 524/305

[58] Field of Search ..... 106/210–214, 106/243; 524/46, 52, 306

[56] References Cited

U.S. PATENT DOCUMENTS

| | | | |
|---|---|---|---|
| 3,869,296 | 3/1975 | Kelly, Jr. et al. | 106/214 |
| 4,025,474 | 5/1977 | Porter, Jr. et al. | 528/245.5 |
| 4,274,986 | 1/1981 | Ikenaga et al. | 528/230 |
| 4,343,655 | 8/1982 | Dodd | 106/214 |
| 4,537,634 | 8/1985 | Floyd | 106/214 |
| 4,547,580 | 10/1985 | Floyd | 549/379 |
| 4,656,296 | 4/1987 | Floyd | 549/379 |
| 4,659,489 | 4/1987 | Hill | 252/40.5 |
| 4,676,836 | 1/1987 | Hill | 106/243 |
| 4,705,570 | 11/1987 | Paul | 106/124 |

OTHER PUBLICATIONS

"Paper Coating Additives", Landes et al, pp. 80–105.

*Primary Examiner*—Theodore Morris
*Attorney, Agent, or Firm*—Mitchell D. Bittman

[57] ABSTRACT

Paper coating compositions contain at least one pigment, at least one binder, and as an insolubilizer for the binder, the product of reacting glyoxal with a polyhydroxyl substituted ester, then with a polyol.

14 Claims, No Drawings

LUBRICATING INSOLUBILIZER FOR PAPER COATING COMPOSITION

BACKGROUND OF THE INVENTION

This invention relates to paper coating compositions. More particularly it relates to novel products for insolubilizing the binders in coatings for paper.

Paper coating compositions are generally a fluid suspension of pigments, such as clay with or without titanium dioxide, calcium carbonate, or the like, in an aqueous medium which includes a binder such as starch, modified starch, styrene-butadiene copolymer, acrylic polymer, or protein to adhere the pigment to paper.

The hydrophilic nature of the binder requires the presence of an insolubilizing material which crosslinks the binder, making it hydrophobic and thus improving the characteristics of the surface of the coated paper.

The most widely-used crosslinking materials are glyoxal, blocked glyoxal resins and formaldehyde-donor agents such as melamineformaldehyde, ureamelamineformaldehyde, and partially or wholly methylated derivatives thereof.

Glyoxal is a highly reactive monomer which cures quickly and has excellent insolubilizing properties. As a result of this rapid crosslinking of glyoxal and binder, however, the viscosity of the coating composition increases so rapidly and is so great that the composition cannot be used. Frequently glyoxal-insolubilized coatings gel completely, particularly in high solids formulations; gelling can occur also in moderate or low solids formulations if they are not used promptly. Thus in situations where it is required that viscosity remain stable for many hours, for example when high-solids coatings are to be applied by blade coating techniques, a glyoxal system is unsuitable.

Melamineformaldehyde resins do not build viscosity in the coating compositions, but they have the disadvantage of having an unpleasant odor and of releasing free formaldehyde. Curing with such resins involves the crosslinking of the binder molecule with the methylol or methylated methylol group of the melamine resin, usually in an acid or neutral coating, and full insolubilization of the binder takes place slowly over a period of several days. Free formaldehyde can be released either directly from the coating mixture or when the coating is cured on the drying machine. The presence of even less than one percent of free formaldehyde, based on the total weight of the product, is undesirable, not only because of its objectionable odor, but because it is an allergen and an irritant, causing severe reactions in the operators who manufacture the coatings and who treat and handle the coated paper.

The use of the reaction product of urea and glyoxal as an insolubilizer is known (U.S. Pat. No. 3,869,296). Treating agents formed by the reaction of ethylene urea with glyoxal are disclosed in Japanese publication No. 5 3044-567, but they too do not have satisfactory properties. U.S. Pat. No. 4,343,655 teaches the use of the alkylated products of the reaction of glyoxal and cyclic ureas as crosslinking resins for binders for paper coating compositions.

The use of the reaction product of glyoxal and polyol is disclosed in U.S. Pat. No. 4,656,296. However, the reacting product of this invention also lubricates in addition to insolubilizing the binder and produces a higher gloss finish on the paper.

SUMMARY OF THE INVENTION

It has now been found that the products of reacting glyoxal with a polyhydroxyl substituted ester and then a polyol are excellent crosslinking resins for binders for paper coating compositions. They do not build viscosity as does glyoxal; they do not contain or evolve free formaldehyde; in smaller amounts, they have insolubilizing effects similar to those of the previously known agents; they provide lubrication in addition to insolubilizing the binder; and they provide a high gloss finish to the paper.

DETAILED DESCRIPTION OF THE INVENTION

In accordance with the present invention, novel compounds are prepared that are useful for insolubilizing starch and other commonly used binders for paper coating compositions. The products are prepared by reacting glyoxal with a polyhydroxyl substituted ester and then with a polyol. In general, 20 to 60% by weight of glyoxal is reacted with 30 to 70% by weight of polyhydroxyl substituted ester and then with 5 to 25% by weight of polyol.

The glyoxal is first reacted with a polyhydroxyl substituted ester, preferably a sorbitan ester. The sorbitan ester can be any one of sorbitan monolaurate, sorbitan monoleate, sorbitan monostearate, sorbitan monopolmitate and their mixtures, or can be derived by reacting sorbitol with a fatty acid having 12 to 24 carbon atoms.

The polyhydroxyl substituted ester can also be the reaction product of a fatty acid and a polyol with this polyol containing at least three hydroxyl groups such as trimethylol ethane, trimethylol propane, glycerine, and pentaerythritol. The fatty acid can be of the type with C12 to C24 in chain length. Some typical esters are glycerol monostearate, glycerol monopalminate, glycerol myristate, trimethylol ethane monostearate, trimethylol ethane monopalminate, trimethylol ethane monomyristate, trimethylol propane monostearate, trimethylol propane monopalminate, trimethylol propane monomyristate, pentaerythritol monostearate, pentaerythritol monopalminate and pentaerythritol monomyristate and their mixtures.

The reaction product of glyoxal and polyhydroxyl substituted ester is then reacted with polyol to provide stability to the system in emulsion form and as a paper coating. The polyol contains two or more hydroxyl groups such as ethylene glycol, glycerine, sorbitol, propylene glycol or trimethylol propane and mixtures thereof.

The reaction of the glyoxal, polyhydroxyl substituted ester and then the polyol generally takes place at a temperature between room temperature and reflux, and preferably at about 70° to 90° C. The reaction time is generally about 1 hour to 8 hours, and preferably it is about 4 hours. Vacuum may be applied to remove water until the desired solids content is attained. In general about 15 to 24" Hg of vacuum is applied at a temperature necessary to distill water.

The pH of the reaction mixture must be less than 8, and preferably it is between about 3 and 6. If it is necessary to raise the pH, a reagent such as sodium bicarbonate can be used.

The insolubilizer containing the reaction product preferably contains a surfactant. The insolubilizer preferably contains 10 to 50% by weight of the reaction product, 1 to 15% by weight of a surfactant and 35 to 90% by weight of water. Preferably the surfactant is a non-ionic surfactant such as a nonylphenol-ethylene oxide adduct (1 to 40 moles), a octylphenol-ethylene oxide adduct (1 to 40 moles), a lauryl alcohol-ethylene oxide adduct (4 to 23 moles), a stearyl alcohol-ethylene oxide adduct (20 to 25 moles), a tridecyl alcohol-ethylene oxide adduct (5 to 18 moles), a sorbitan mono-oleate-ethylene oxide adduct (5 to 20 moles) or a sorbitan monostearate-ethylene oxide adduct (3 to 10 moles).

It is believed that the novel compounds of this invention function by breaking down, during cure conditions and not before, into the polyol, polyhydroxyl substituted ester and glyoxal, the glyoxal then reacting with the binder. Thus, for example, when decomposed in the presence of starch, the breakdown product glyoxal reacts with the starch.

Because of their monomeric nature, these new compounds can be dispersed more easily and more uniformly, giving better printing properties on the paper.

Since there is no formaldehyde in the system, the problems found with free formaldehyde are avoided. The novel products of this invention do not contain or evolve free formaldehyde, as do the conventional melamineformaldehyde and urea-melamineformaldehyde crosslinking agents. Smaller amounts of the compounds of this invention produce insolubilizing effects comparable to those of the conventional materials and they satisfactorily insolubilize the pigment binders, but do not build viscosity as does glyoxal.

The binders used in the paper coating composition of this invention include, but are not limited to, unmodified starch; oxidized starch; enzyme-converted starch; starches having functional groups such as hydroxyl, carbonyl, amido, and amino groups; proteins, such as casein; latexes, such as styrene-butadiene copolymer; and the like, and their mixtures.

The pigments may be clay with or without titanium dioxide and/or calcium carbonate, and the like, and mixtures thereof.

In addition to the binder, the pigment material, and the insolubilizer described above, paper compositions may also include conventional materials such as lubricants, defoamers, preservatives, colored pigments, and the like, in conventional amounts.

In the paper coating compositions described herein, the amount of binder is based upon the amount of pigment; the ratio varies with the amount of bonding desired and with the adhesive characteristics of the particular binder employed. In general, the amount of binder is about 4 to 25 percent, and preferably about 10 to 20 percent, based on the weight of the pigment.

The amount of insolubilizer varies with the amount and properties of the binder and the amount of insolubilization desired; in general it is about 1 to 12 percent, and preferably about 4 to 8 percent, based on the weight of the binder.

The total solids content of the paper coating composition generally is within the range of about 50 to 70 percent, depending upon the method of application and the product requirements.

The paper coating compositions of this invention can be applied to paper or paper-like substrates by any known and convenient means.

Although this invention will be described in relation to insolubilizers for binders for paper coating compositions, it is not intended to be limited thereto. The products of this invention can be used in other applications where glyoxal is commonly used, such as for example in treating textiles, strength resins, acrylic polymers, and the like.

In order that the present invention may be more fully understood, the following examples are given by way of illustration. No specific details contained therein should be construed as limitations on the present invention except insofar as they appear in the appended claims. Unless otherwise specified, all parts and percentages are by weight.

EXAMPLE #1

To a clean kettle, the polyhydroxyl substituted ester and glyoxal are charged. The mixture is heated with agitation to 40°–70° C. and held for two hours. The polyol and mineral acid is then charged and held for one to two hours. Vacuum is applied to remove the water and water is distilled until at least of 90% calculated water is collected.

| | Sample A | Sample B | Sample C |
|---|---|---|---|
| Sorbitan Monostearate | 51.12 | 61.50 | — |
| Glycerol Monostearate | — | — | 67.69 |
| Glyoxal | 38.14 | 29.95 | 25.16 |
| Propylene Glycol | 10.58 | 8.39 | 6.99 |
| Sulfuric Acid | .10 | .10 | .10 |
| Sodium Hydroxide | .06 | .06 | .06 |
| Sodium Bicarbonate | — | — | .01 |

Each of the above reaction products was mixed with a surfactant and water to a level of 30% solids with Samples A and B mixed with 2.6% of a surfactant (a mixture of stearyl alcohol-23 moles ethylene oxide adduct and lauryl alcohol-23 moles ethylene oxide adduct) and Sample C mixed with 2.8% of a surfactant (nonylphenol-40 moles ethylene oxide adduct). The water, reaction product and surfactant were charged to a kettle, heated to 60°–80° C. with agitation until all melted, evenly dispersed and emulsified.

EXAMPLES #2–6

The Samples A, B and C prepared in Example #1 were then evaluated and compared to a cyclic urea-glyoxal condensate insolubilizer (Sunrez® 700M by Sequa Chemicals, Inc.) in a coating mix as follows:

| Example | 2 | 3 | 4 | 5 | 6 |
|---|---|---|---|---|---|
| #1 Clay | 100 | 100 | 100 | 100 | 100 |
| Dispex N-40 (Allied Colloid Ltd.) acrylic dispersant | .15 | .15 | .15 | .15 | .15 |
| Dow 620A (Dow Chemical Co.) styrene-butadiene copolymer | 8 | 8 | 8 | 8 | 3 |
| PG 280 (Penick and Ford Corp.) hydroxyethylated starch | 8 | 8 | 8 | 8 | 8 |
| Calcium Stearate | — | 1.0 | — | — | — |
| Insolubilizer (Sunrez ® 700 M) | — | .25 | — | — | — |
| Sample A | — | — | 1.25 | — | — |
| Sample B | — | — | — | 1.25 | — |
| Sample C | — | — | — | — | 1.25 |
| Solids | 59.7 | 59.7 | 59.7 | 59.6 | 59.0 |
| pH | 8.1 | 8.1 | 8.1 | 8.1 | 8.0 |

The above coatings were coated on paper with a laboratory web blade coater and the following tests were run with these results:

| Example | 2 | 3 | 4 | 5 | 6 |
|---|---|---|---|---|---|
| Brookfield Visc. (of coating) | 4500 | 7250 | 11750 | 12650 | 6300 |
| Hercules Visc. (of coating) | 64 | 61 | 56 | 66 | 59 |

-continued

| Example | 2 | 3 | 4 | 5 | 6 |
|---|---|---|---|---|---|
| Coated Wt. lbs./3300 sq. ft. | 8.4 | 8.1 | 8.6 | 8.4 | 8.1 |
| Brightness | 82.0 | 81.9 | 81.9 | 81.9 | 80.7 |
| Gloss/Initial, 75° | 22 | 19 | 20 | 20 | 24 |
| 800 pli, 3 nips, 25° C. | 57 | 57 | 62 | 57 | 64 |
| 1200 pli, 2 nips, 140° | 74 | 74 | 72 | 72 | 78 |
| Printed Ink 60° | 71 | 65 | 74 | 64 | 96 |
| IGT | | | | | |
| Dry Pick | 116 | 133 | 129 | 141 | 77 |
| Wet Pick | 105 | 100 | 115 | 130 | 16 |
| SIWA Brightness | 68.2 | 61.7 | 65.3 | 64.5 | 73 |
| Adams Wet Rub | 74 | 62 | 50 | 60 | 33 |

The application testing shows that the insolublizers of Samples A, B and C work as both a lubricant and an insolubilizer. The gloss numbers for Samples A, B and C were at least equal to or improved compared to a conventional lubricant (calcium stearate). The Pick Numbers for Examples 2–5 were all run at the same time and there was no significant difference in the surface strength measured therein compared to a commercially available cyclic urea-glyoxal condensate insolubilizer. Example 6 was run at a separate time, but showed no difference in surface strength from repeat of a control of Examples 2 and 3.

The SIWA brightness indicated no significant variation between Examples 2–5, with Example 6 showing a decrease in the ability to absorb water. In the Adams Wet Rub, a lower number indicated resistance to water, with the Samples A, B and C showing improved resistance.

What is claimed is:

1. A lubricating insolubilizer for binders for paper coating compositions which comprises the reaction product of glyoxal with a polyhydroxyl substituted ester selected from the group consisting of sorbitan monolaurate, sorbitan mon-oleate, sorbitan monostearate, sorbitan monopalmitate, glycerol monostearate, glycerol monopalminate, glycerol monomyristate, trimethylol ethane monostearate, trimethylol ethane monopalminate, trimethylol ethane monomyristate, trimethylol propane monostearate, trimethylol propane monopalminate, trimethylol propane monomyristate, pentaerythritol monostearate, pentaerythritol monopalminate and pentaerythritol monomyristate and their mixtures, and then with a polyol containing two or more hydroxyl groups selected from the group consisting of ethylene glycol, glycerin, propylene glycol, trimethylol propane, sorbitol and their mixtures.

2. The insolubilizer of claim 1 wherein the polyhydroxyl substituted ester is present in an amount of about 30 to 70% by weight, the glyoxal is present in an amount of about 20 to 60% by weight and the glycol is present in an amount of about 5 to 25% by weight.

3. The insolubilizer of claim 2 further comprising a surfactant.

4. The insolubilizer of claim 3 comprising 10 to 50% by weight of the reaction product, 1 to 15% of the surfactant and 35 to 90% by weight of water.

5. The reaction product of glyoxal with a polyhydroxl substituted ester selected from the group consisting of sorbitan monolaurate, sorbitan mono-oleate, sorbitan monostearate, sorbitan monopalmitate, glycerol monostearate, glycerol monopalminate, glycerol monomyristate, trimethylol ethane monostearate, trimethylol ethane monopalminate, trimethylol ethane monomyristate, trimethylol propane monostearate, trimethylol propane monopalminate, trimethylol propane monomyristate, pentaerythritol monostearate, pentaerythritol monopalminate and pentaerythritol monomyristate and their mixtures, and then with a polyol containing two or more hydroxyl groups selected from the group consisting of ethylene glycol, glycerin, propylene glycol, trimethylol propane, sorbitol and their mixtures.

6. The reaction product of claim 5 wherein the polyhydroxyl substituted ester is present in an amount of about 30 to 70% by weight, the glyoxal is present in an amount of about 20 to 60% by weight and the polyol is present in an amount of about 5 to 25% by weight.

7. The reaction product of claim 6 further comprising a surfactant.

8. The reaction product of claim 7 comprising 10 to 50% by weight of the reaction product, 1 to 15% by weight of the surfactant and 35 to 90% by weight of water.

9. A paper coating composition comprising a pigment, a binder, and as an insolubilizer for the binder the reaction product of glyoxal with a polyhydroxyl substituted ester selected from the group consisting of sorbitan monolaurate, sorbitan mono-oleate, sorbitan monostearate, sorbitan monopalmitate, glycerol monostearate, glycerol monopalminate, glycerol monomyristate, trimethylol ethane monostearate, trimethylol ethane monopalminate, trimethylol ethane monomyristate, trimethylol propane monostearate, trimethylol propane monopalminate, trimethylol propane monomyristate, pentaerythritol monostearate, pentaerythritol monopalminate and pentaerythritol monomyristate and their mixtures, and then with a polyol containing two or more hydroxyl groups selected from the group consisting of ethylene glycol, glycerin, propylene glycol, trimethylol propane, sorbitol and their mixtures.

10. The composition of claim 9 wherein the polyhydroxyl substituted ester is present in an amount of about 30 to 70% by weight of the insolubilizer, the glyoxal is present in an amount of about 20 to 60% by weight of the insolubilizer and the polyol is present in an amount of about 5 to 25% by weight of the insolubilizer.

11. The composition of claim 10 wherein the insolubilizer further comprises a surfactant.

12. The composition of claim 11 wherein the insolubilizer comprises 10 to 50% by weight of the reaction product, 1 to 15% by weight of the surfactant and 35 to 90% by weight of water.

13. The composition of claim 9 wherein the binder is a starch.

14. The composition of claim 12 wherein the insolubilizer is present at 1 to 12% by weight of the binder.

* * * * *